US009964354B2

(12) United States Patent
Musicus

(10) Patent No.: US 9,964,354 B2
(45) Date of Patent: May 8, 2018

(54) METHOD FOR PRODUCING PRESSURIZED GASEOUS OXYGEN THROUGH THE CRYOGENIC SEPARATION OF AIR

(71) Applicant: L'Air Liquide, Societe Anonyme pour l'Etude et l'Exploitation des Procedes Georges Claude, Paris (FR)

(72) Inventor: Paul Musicus, Houston, TX (US)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 109 days.

(21) Appl. No.: 15/000,583

(22) Filed: Jan. 19, 2016

(65) Prior Publication Data

US 2017/0205141 A1 Jul. 20, 2017

(51) Int. Cl.
*F25J 3/00* (2006.01)
*F25J 3/04* (2006.01)

(52) U.S. Cl.
CPC ..... *F25J 3/04812* (2013.01); *F25J 3/042* (2013.01); *F25J 3/0409* (2013.01); *F25J 3/04175* (2013.01); *F25J 3/04296* (2013.01); *F25J 3/04393* (2013.01); *F25J 2240/42* (2013.01); *F25J 2245/40* (2013.01)

(58) Field of Classification Search
CPC ..... F25J 3/04303; F25J 3/04412
USPC ..... 62/646, 656
See application file for complete search history.

(56) References Cited

U.S. PATENT DOCUMENTS

| | | | | |
|---|---|---|---|---|
| 5,355,682 | A | 10/1994 | Agrawal et al. | |
| 5,440,884 | A * | 8/1995 | Bonaquist | F25J 3/0409 62/646 |
| 5,454,227 | A | 10/1995 | Straub et al. | |
| 5,511,381 | A | 4/1996 | Higginbotham | |
| 5,522,224 | A * | 6/1996 | Canney | F25J 3/04254 62/656 |
| 5,533,339 | A | 7/1996 | Clare et al. | |
| 5,806,341 | A | 9/1998 | Rathbone | |
| 5,809,802 | A | 9/1998 | Rathbone | |
| 6,622,521 | B2 * | 9/2003 | Seiver | F25J 3/04412 62/656 |
| 2003/0051504 | A1 | 3/2003 | Corduan et al. | |
| 2015/0168056 | A1 | 6/2015 | Musicus | |

OTHER PUBLICATIONS

International Search Report and Written Opinion for PCT/US2014/070324, dated Oct. 8, 2015.

* cited by examiner

*Primary Examiner* — Melvin Jones
(74) *Attorney, Agent, or Firm* — Justin K. Murray

(57) ABSTRACT

A method is provided for production of gaseous oxygen at high pressures by splitting a main air feed into at least three separate streams, with the first stream being fed to a heat exchanger and then a column system for rectification; the second stream being further compressed in a warm booster, partially cooled in the heat exchanger, expanded in a turbine coupled to the warm booster and then fed to the column system; the third stream being expanded in a warm expander before being introduced to the heat exchanger and introduced to the column system. In certain embodiments, substantially all of the main air feed is eventually introduced to the column system for rectification, resulting in reduced sizing of a main air compressor and improved product recoveries.

15 Claims, 1 Drawing Sheet

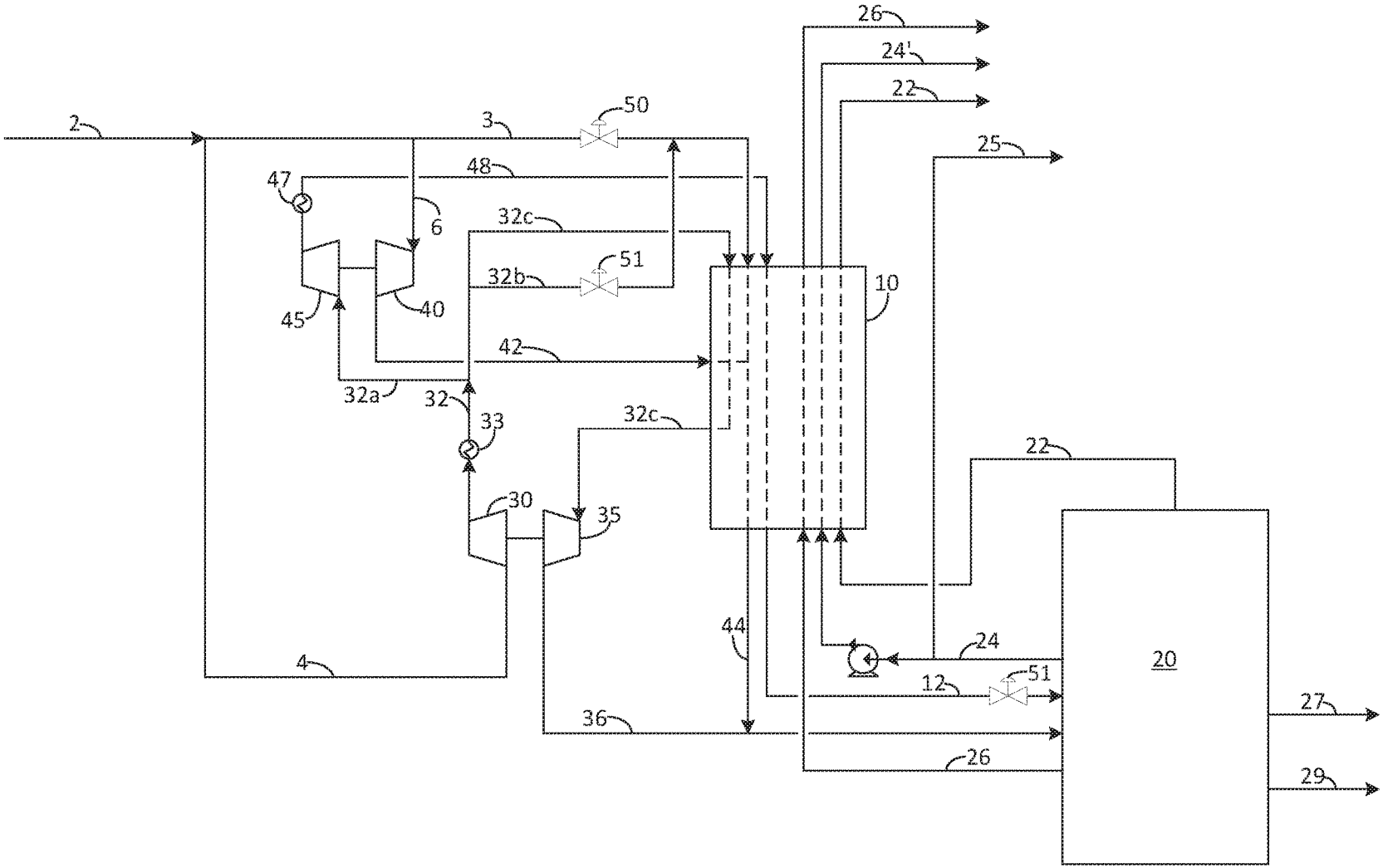
2
3
4
6
10
12
20
22
22
24
24'
25
26
26
27
29
30
32
32a
32b
32c
32c
33
35
36
40
42
44
45
47
48
50
51
51

METHOD FOR PRODUCING PRESSURIZED GASEOUS OXYGEN THROUGH THE CRYOGENIC SEPARATION OF AIR

TECHNICAL FIELD OF THE INVENTION

The present invention relates to a process for separating air into its components. More specifically, embodiments of the present invention are related to producing oxygen and optionally nitrogen at moderate pressures by the use of a warm expander.

SUMMARY OF THE INVENTION

Certain embodiments of the present invention relate to a method for producing high pressure gaseous oxygen, preferably between 20 and 60 bara, through the cryogenic separation of air at moderate pressures by the use of a warm expander.

In one embodiment, the method can include the steps of obtaining a main air feed comprising filtered and compressed air, preferably at a pressure greater than 15 bara; splitting the main air feed into at least a first air fraction, a second air fraction, and a third air fraction; fully cooling the first air fraction in a heat exchanger to a temperature suitable for rectification of the first air fraction to form a cooled air feed; withdrawing the cooled air feed from the heat exchanger and introducing the cooled air feed to a column system under conditions effective for rectification of the cooled air feed into low pressure gaseous nitrogen (LP GAN), liquid oxygen (LOX), liquid nitrogen (LIN), and high pressure gaseous nitrogen (HP GAN), wherein the column system comprises a double column having a higher pressure column and a lower pressure column; warming the LP GAN, LOX, and HP GAN in the heat exchanger; boosting the second air fraction in a warm booster to form a boosted second air fraction; partially cooling a first portion of the boosted second air fraction in the heat exchanger and then expanding the first portion of the boosted second air fraction in a cold turbine to form an expanded second air fraction; introducing the expanded second air fraction to the column system; compressing a second portion of the boosted second air fraction in a second warm booster to form a second boosted second air fraction; fully cooling the second boosted second air fraction in the heat exchanger to form a second cooled air feed; withdrawing the second cooled air feed from the heat exchanger and introducing the second cooled air feed to the column system; expanding the third air fraction using a warm expander to create an expanded third air fraction, wherein the warm expander powers the second warm booster; and cooling the expanded third air fraction in the heat exchanger before introducing the expanded third air fraction to the column system for rectification. In one embodiment, LIN can be warmed in the heat exchanger. In one embodiment, the main air feed is at a pressure of at least 15 bar, preferably at least 20 bar.

In another embodiment, the expanded second air fraction is at about the same pressure as the higher pressure column. In another embodiment, the cold turbine is coupled to the warm booster. In another embodiment, the method can include the step of withdrawing LIN from the column system as product.

In another embodiment, the LOX can be vaporized in the heat exchanger and have a pressure of about 20-60 bar. In another embodiment, substantially all of the main air feed is introduced to the column system for rectification. In another embodiment, substantially none of the main air feed is vented to the atmosphere. In another embodiment, the third air fraction is at substantially the same pressure as the second air fraction and the first air fraction.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE provides an embodiment of the present invention.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

FIG. 1 represents an embodiment of the present invention. In this embodiment, main air feed 2 can be split into three streams, first air fraction 3, second air fraction 4, and third air fraction 6. First air fraction 3 is then preferably expanded across valve 50 and then introduced to the warm side of heat exchanger 10 and is fully cooled therein, and preferably condensed. Preferably, main air feed 2 has a pressure of at least 15 bar, preferably at least 20 bar or even at least 30 bar.

Low pressure gaseous nitrogen 22 is withdrawn from column system 20 and is warmed in heat exchanger 10 before exiting, to be eventually used to regenerate compressed air filters (not shown), vented to the atmosphere, or used as product. Liquid oxygen 24 is also withdrawn from column system 20 pressurized in a pump and then vaporized in heat exchanger 10 to form high pressure gaseous oxygen. Liquid oxygen product stream 25 is taken as a slip stream of liquid oxygen 24 and can be stored as product. High pressure gaseous nitrogen 26 and liquid nitrogen 27 are also withdrawn from column system 20. High pressure gaseous nitrogen 26 is warmed in heat exchanger 10 and liquid nitrogen 27 can be stored as product. In another embodiment, liquid argon 29 leaves column system 20 and can be stored as product. In an embodiment not shown, waste gas from column system 20 can be used to provide cooling to heat exchanger 10 and/or used to regenerate air adsorbers. In a preferred embodiment, column system 20 can include a higher pressure column, a lower pressure column, and an argon column.

In one embodiment, second air fraction 4 is compressed in warm booster 30 and cooled in aftercooler 33 to form boosted second air fraction 32. Boosted second air fraction 32 is then split into three streams 32*a*, 32*b*, and 32*c*. Stream 32*a* is further compressed in second warm booster 45 and cooled in aftercooler 47 to form boosted air stream 48. Boosted air stream 48 is then cooled in heat exchanger 10 to form cooled air feed 12, before being expanded through valve 51 and introduced to column system 20 for rectification. Stream 32*c* is partially cooled (i.e., taken out at an intermediate location of heat exchanger 10) in heat exchanger 10 and expanded across turbine 35 to form expanded second air fraction 36 and then introduced to column system 20 for rectification. Turbine 35 is connected to warm booster 30 by a common shaft, such that turbine 35 provides the power needed to drive warm booster 30. Stream 32*b* is expanded across valve 51 to the same pressure as first air fraction 3 following expansion across valve 50. Stream 32*b* is preferably combined with first air fraction 3 upstream of heat exchanger 10, such that the combined stream is fully cooled within said heat exchanger 10.

In one embodiment, third air fraction 6, which is preferably at ambient air temperatures, is expanded across warm expander 40 to form expanded third air fraction 42. Expanded third air fraction 42 is then introduced to heat exchanger 10, preferably at an intermediate location where it is mixed with first air fraction 3 and stream 32*b* to form combined cooled fractions 44, fully cooled and combined with expanded second air fraction 36 before introduction to column system 20 for rectification. In a preferred embodiment, the combined streams 36,44 are introduced to the higher pressure column. In the embodiment shown, the warm expander is coupled to a second warm compressor 45.

The advantage of including pressure valve 50 is to allow for partial loading of the plant or to produce reduced quantities of liquid products. This permits the plant to operate with the optimum flow of Joule-Thompson air per the liquid vaporization occurring in heat exchanger 10. Certain embodiments of the invention are suitable for the production of gaseous oxygen in the range of about 20 to 60 bara by replacing a typical "lost air" turbine with the warm turbine/booster (40/45). Certain embodiments of the present invention allow for large quantities of liquid products (e.g., 10-20% of the total air flow) while consuming less power than a "lost air" process and with less complexity (e.g., up to 10% savings in power as compared to lost air type). Additionally, in certain embodiments of the present invention, essentially all of the main air enters the column system for separation (as opposed to a portion being used for refrigeration and then vented), thus permitting maximum product recoveries.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps or devices can be combined into a single step/device.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

I claim:

1. A method for producing pressurized gaseous oxygen through the cryogenic separation of air, the method comprising the steps of:

obtaining a main air feed comprising filtered and compressed air;

splitting the main air feed into at least a first air fraction, a second air fraction, and a third air fraction;

fully cooling the first air fraction in a heat exchanger to a temperature suitable for rectification of the first air fraction to form a cooled air feed;

withdrawing the cooled air feed from the heat exchanger and introducing the cooled air feed to a column system under conditions effective for rectification of the cooled air feed into low pressure gaseous nitrogen (LP GAN), liquid oxygen (LOX), liquid nitrogen (LIN), and high pressure gaseous nitrogen (HP GAN), wherein the column system comprises a double column having a higher pressure column and a lower pressure column;

warming the LP GAN, LOX, and HP GAN in the heat exchanger;

boosting the second air fraction in a first warm booster to form a boosted second air fraction;

partially cooling a first portion of the boosted second air fraction in the heat exchanger and then expanding the first portion of the boosted second air fraction in a cold turbine to form an expanded second air fraction;

introducing the expanded second air fraction to the column system;

compressing a second portion of the boosted second air fraction in a second warm booster to form a second boosted second air fraction;

fully cooling the second boosted second air fraction in the heat exchanger to form a second cooled air feed;

withdrawing the second cooled air feed from the heat exchanger and introducing the second cooled air feed to the column system;

expanding the third air fraction using a warm expander to create an expanded third air fraction, wherein the warm expander powers the second warm booster; and cooling the expanded third air fraction in the heat exchanger before introducing the expanded third air fraction to the column system for rectification.

2. The method as claimed in claim 1, wherein the expanded second air fraction is at the same pressure as the higher pressure column.

3. The method as claimed in claim 1, wherein the main air feed has a pressure of least 10 bar.

4. The method as claimed in claim 1, wherein the main air feed has a pressure of at least 20 bar.

5. The method as claimed in claim 1, wherein the cold turbine is coupled to the first warm booster.

6. The method as claimed in claim 1, further comprising withdrawing LIN from the column system as product.

7. The method as claimed in claim 1, wherein the LOX is vaporized in the heat exchanger and has a pressure of about 20-60 bar after being warmed in the heat exchanger.

8. The method as claimed in claim 1, wherein substantially all of the main air feed is introduced to the column system for rectification.

9. The method as claimed in claim 1, wherein substantially none of the main air feed is vented to the atmosphere.

10. The method as claimed in claim 1, wherein the third air fraction is at substantially the same pressure as the second air fraction and the first air fraction.

11. The method as claimed in claim 1, wherein the expanded second air fraction and the expanded third air fraction are sent to the same location within the column system.

12. The method as claimed in claim 1, wherein the column system comprises an absence of a mixing column.

13. The method as claimed in claim 1, wherein the column system consists essentially of a higher pressure column, a lower pressure column and an argon column.

14. A method for producing pressurized gaseous oxygen through the cryogenic separation of air, the method comprising a first operation mode and a second operation mode, wherein in both the first operation mode and the second operation mode, wherein in the first operation mode, the method comprises the steps of:

obtaining a main air feed comprising filtered and compressed air having a pressure of at least 15 bara;

splitting the main air feed into at least a first air fraction, a second air fraction, and a third air fraction;

fully cooling the first air fraction in a heat exchanger to a temperature suitable for rectification of the first air fraction to form a cooled air feed;

withdrawing the cooled air feed from the heat exchanger and introducing the cooled air feed to a column system under conditions effective for rectification of the cooled air feed into low pressure gaseous nitrogen (LP GAN), liquid oxygen (LOX), liquid nitrogen (LIN), and high pressure gaseous nitrogen (HP GAN), wherein the column system comprises a double column having a higher pressure column and a lower pressure column;

warming the LP GAN, LOX, and HP GAN in the heat exchanger;

boosting the second air fraction in a first warm booster to form a boosted second air fraction;

partially cooling a first portion of the boosted second air fraction in the heat exchanger and then expanding the first portion of the boosted second air fraction in a cold turbine to form an expanded second air fraction;

introducing the expanded second air fraction to the column system;

expanding the third air fraction using a warm expander to create an expanded third air fraction; and cooling the expanded third air fraction in the heat exchanger before introducing the expanded third air fraction to the column system for rectification, wherein in the second operation mode, the method further comprises the steps of:

opening a Joule-Thompson valve in fluid communication with the boosted second air fraction and diverting a third portion of the boosted second air fraction through the Joule-Thompson valve and combining the third portion of the boosted second air fraction with the first air fraction upstream the heat exchanger;

introducing the third portion of the boosted second air fraction, along with the first air fraction, into the heat exchanger for cooling before introducing the third portion of the boosted second air fraction, along with the first air fraction, to the column system;

compressing a second portion of the boosted second air fraction in a second warm booster to form a second boosted second air fraction;

fully cooling the second boosted second air fraction in the heat exchanger;

expanding the cooled second boosted second air fraction across a valve and then introducing the expanded cooled second boosted second air fraction to the higher pressure column, wherein the method switches from the first operation mode to the second operation mode based upon a determination to produce less quantity of liquid products, wherein the liquid products comprise LOX and LIN.

15. A method for producing pressurized gaseous oxygen through the cryogenic separation of air, the method comprising the steps of:

obtaining a main air feed comprising filtered and compressed air having a pressure of at least 15 bara;

splitting the main air feed into at least a first air fraction, a second air fraction, and a third air fraction;

fully cooling the first air fraction in a heat exchanger to a temperature suitable for rectification of the first air fraction to form a cooled air feed;

withdrawing the cooled air feed from the heat exchanger and introducing the cooled air feed to a column system under conditions effective for rectification of the cooled air feed into low pressure gaseous nitrogen (LP GAN), liquid oxygen (LOX), liquid nitrogen (LIN), and high pressure gaseous nitrogen (HP GAN), wherein the column system comprises a double column having a higher pressure column and a lower pressure column;

warming the LP GAN, LOX, and HP GAN in the heat exchanger;

boosting the second air fraction in a first warm booster to form a boosted second air fraction;

partially cooling a first portion of the boosted second air fraction in the heat exchanger and then expanding the first portion of the boosted second air fraction in a cold turbine to form an expanded second air fraction;

introducing the expanded second air fraction to the column system;

expanding the third air fraction using a warm expander to create an expanded third air fraction; and cooling the expanded third air fraction in the heat exchanger before introducing the expanded third air fraction to the column system for rectification, wherein the expanded second air fraction and the expanded third air fractions are sent to the same location within the column system.

* * * * *